United States Patent [19]

Lusko

[11] 3,962,768

[45] June 15, 1976

[54] METHOD OF MAKING TAPE SPRING

[76] Inventor: Michael Lusko, 25330 John R, Madison Heights, Mich. 48071

[22] Filed: Feb. 10, 1975

[21] Appl. No.: 548,614

[52] U.S. Cl. ..... 29/173; 156/250; 267/160

[51] Int. Cl.[2] ..... B21F 35/00

[58] Field of Search ..... 29/173; 267/1.5, 160, 267/164; 156/250, 269

[56] References Cited

UNITED STATES PATENTS

| | | | |
|---|---|---|---|
| 1,766,498 | 6/1930 | Frank | 267/1.5 |
| 2,025,334 | 12/1935 | Teetor | 267/1.5 |
| 2,111,258 | 3/1938 | Zahodiakin | 267/1.5 |
| 3,333,669 | 8/1967 | Schaefer | 29/173 X |

*Primary Examiner*—Victor A. DiPalma
*Attorney, Agent, or Firm*—Woodhams, Blanchard and Flynn

[57] ABSTRACT

An elongated band of resiliently flexible material is fed from a roll thereof through guide means. A strip of flexible and compressible material having an adhesive on one side is fed from a roll thereof through a cutting mechanism whereby a pair of elongated, narrow elements is produced. The elements are fed through a portion of the guide means wherein they are both attached to one side of the band along the lengthwise edges thereof. The resultant, elongated workpiece is then fed through a press which sequentially notches the opposite edges of the band, thereby severing the elements, to define a plurality of spaced, transversely extending spring fingers which are all connected to the central portion of the band. The spring fingers are then distorted and the finished, elongated workpiece is then collected in a roll thereof.

6 Claims, 13 Drawing Figures

FIG.7

METHOD OF MAKING TAPE SPRING

FIELD OF THE INVENTION

This invention relates in general to a method and apparatus for fabricating springs used to position and/or tension a magnetic tape in a cartridge wherein the springs are formed transversely in an elongated workpiece so that they can be fed into a machine for separating them and then installing them in the cartridge.

BACKGROUND OF THE INVENTION

Heretofore, it has been the practice to form tape springs from a relatively narrow band of material so that the spring fingers extend lengthwise of the material from which they are made. However, this arrangement of the spring fingers severely limited the number of springs per unit of length of the strip material and also resulted in waste and improper location of the pad material.

The springs are advantageously fabricated from a phosphorous bronze band which is spring tempered but which has previously tended to fatigue when flexed transversely of its lengthwise extent. Thus, attempts to make the springs so that they extend transversely of the band from which they are fabricated has produced a number of problems.

Furthermore, existing methods of forming and arranging the tape springs did not lend themselves to easy and automatic installation of the springs into a tape cartridge.

Accordingly, a primary object of this invention is the provision of a method and apparatus for forming from strip materials a plurality of interconnected, padded springs having spring fingers arranged transversely of the lengthwise extent of said strip materials and formed to permit easy severing of the springs from each other prior to installation in a cartridge.

A further object of this invention is the provision of a method, as aforesaid, which can be completely automatic insofar as the movement of the materials and the shaping and separating of the springs are concerned.

Other objects and purposes of this invention will become apparent to persons familiar with this type of equipment upon reading the following descriptive material and examining the accompanying drawings.

BRIEF DESCRIPTION OF THE DRAWINGS

FIG. 4 is an enlarged fragment of FIG. 2 indicated by the line IV—IV in FIG. 1.

Figure 1:
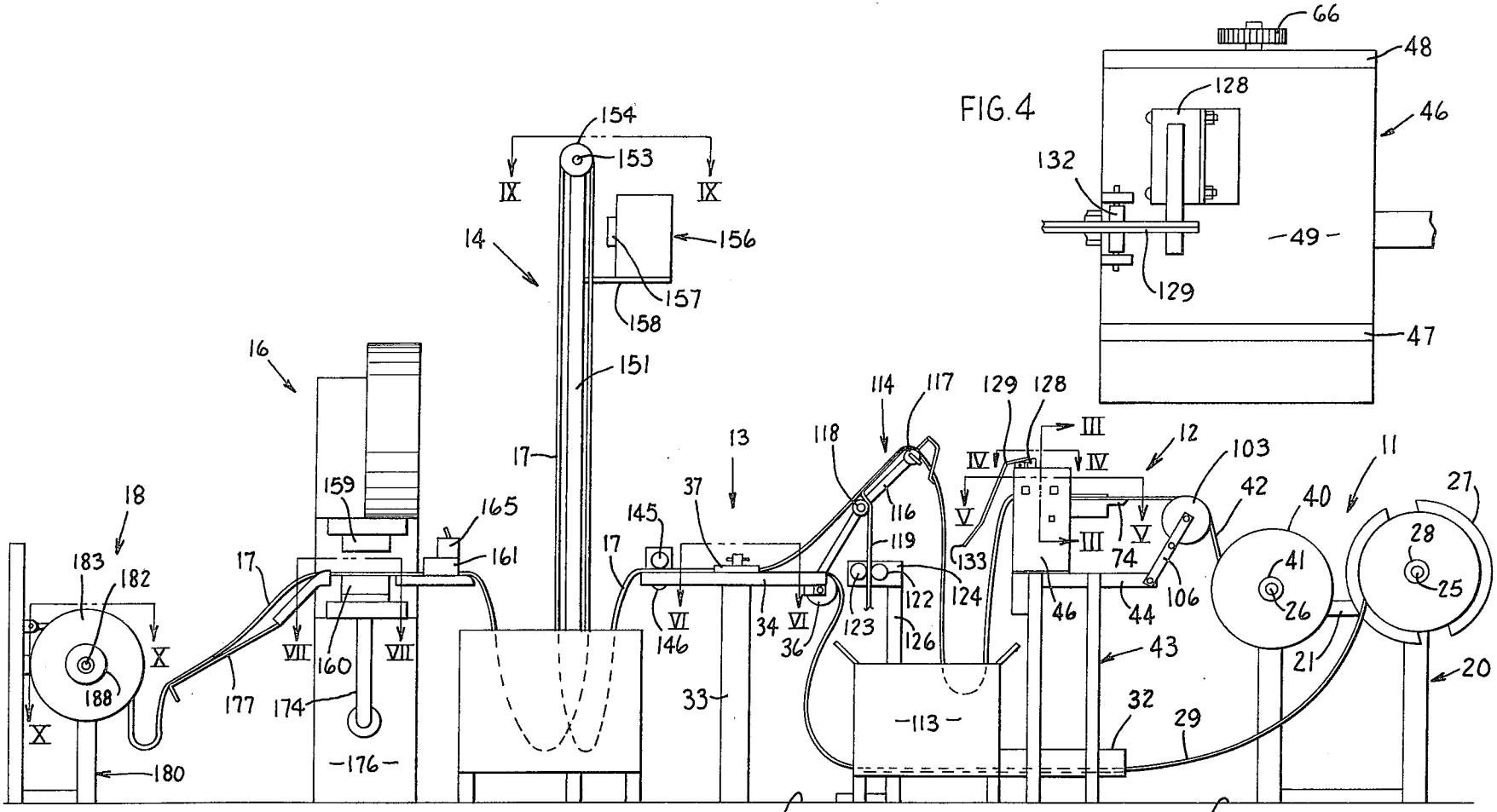
FIG. 1 is a side elevational view of an apparatus by which the method of the invention can be carried out.

For convenience in description, the terms "upper", "lower", "front", "rear", "left", "right" and words of similar import will have reference to the apparatus and flow of the method as appearing in FIG. 1. The words "input" and "output" will have reference to said flow from right to left as appearing in FIG. 1. The words "inner", "outer" and derivatives thereof will have reference to the geometric center of the various components of the apparatus appearing in FIG. 1.

SUMMARY OF THE INVENTION

The objects and purposes of the invention, including those set forth above, have been met by providing an apparatus and method wherein strips or bands of material are caused to move through a plurality of steps and stages wherein the strips are affixed to each other and then notched to form a plurality of interconnected transversely extending spring fingers which are distorted so that they they will have flexibility and durability. The workpiece, comprising a plurality of spring fingers arranged in transversely aligned pairs, is formed in a roll which can then be transported to a location where spring units comprising a pair of aligned spring fingers can be severed from adjacent such units and automatically installed in a tape cartridge for the purpose of positioning and/or tensioning the tape as it moves in the cartridge.

DETAILED DESCRIPTION

Figure 2:
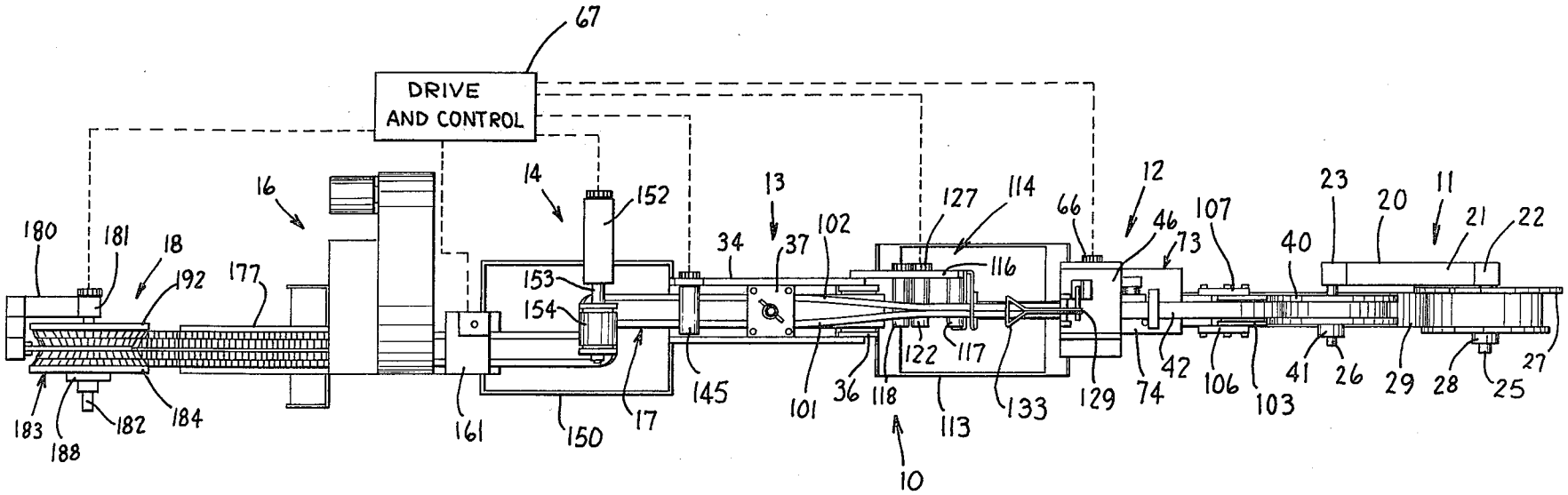
FIG. 2 is a top plan view of said apparatus including a schematic showing of the control system therefor and omitting part of the inspection unit.

In a preferred embodiment of the invention disclosed in FIGS. 1 and 2, the apparatus 10, whereby the method of the invention is carried out, is comprised of plural components which are preferably, but not necessarily, arranged in a straight line. The components include a strip supply 11, a strip splitter 12, a strip joiner 13, an inspection unit 14, a punch press 16 for notching and distorting or bending the workpiece 17 and a workpiece receiving unit 18. Appropriate strip guide mechanisms are provided between or as part of the aforesaid components, which are preferably mounted upon a floor 19.

The strip supply 11 (FIG. 1) comprises a floor-mounted frame 20 having a top frame member 21 upon which are mounted a pair of shaft supports 22 and 23. Shafts 25 and 26 are gripped by, and extend frontwardly from, the supports 22 and 23, respectively. A spool 27 is rotatably supported upon the shaft 25 and held against accidental dislodgement therefrom by a lock collar 28. The spool 27 has thereon an elongated thin and flat band 29 of firm material, such as phosphorous bronze, which has been spring tempered. In this particular embodiment, the band 29 is 1⅝ inches wide and 0.005 of an inch thick, but these dimensions may vary according to the particular application of the spring unit being formed. Also, the band 29 might be made from another material. Said band 29 extends from the spool 27 through a guide tube 32 therefor which extends leftwardly from beneath the strip splitter 12.

The strip joiner 13 comprises a floor mounted pedestal 33 which supports a horizontal platform 34 having a roller 36 rotatably supported upon the rightward end thereof. The strip joiner includes a strip guide 37 through which the band 29 is fed along a specified path.

A spool 40 (FIG. 1) is rotatably supported upon the shaft 26 where it is held by the lock collar 41. A strip 42 of flexible and resiliently compressible material, such as a felt, is carried by the spool 40 and unwound therefrom upon demand. The felt strip in this embodiment is approximately 27/32 of an inch wide and 3/64 of an inch thick.

Figure 5:
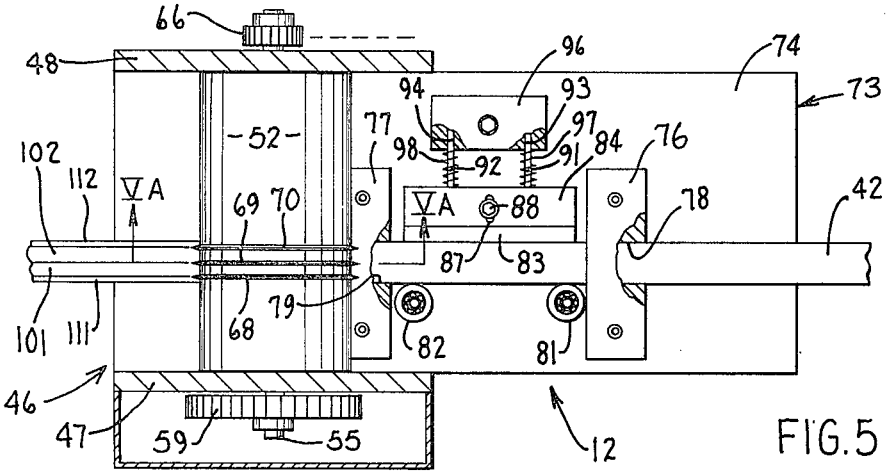
FIG. 5 is an enlarged sectional view taken along the line V—V in FIG. 1.
Figure 3:
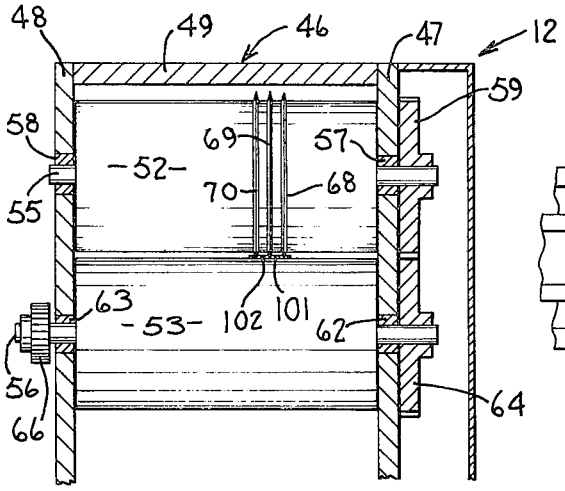
FIG. 3 is an enlarged sectional view taken along the line III—III in FIG. 1.

The strip splitter 12 (FIGS. 1 and 2) has a floor-engaging support 43 with a horizontal platform 44 at the upper end thereof. A cutting head 46, (FIGS. 3, 4 and 5) is mounted upon the platform 44 and has a front wall 47 (FIG. 3) rear wall 48 and top wall 49. A pair of upper and lower rolls 52 and 53, respectively, are mounted upon and secured to the parallel shafts 55 and 56, respectively, and are disposed between the front and rear walls of the cutting head 46. The upper shaft 55 is rotatably supported in bearings 57 and 58 in the front wall 47 and rear wall 48, respectively. The front end of the shaft 55 projects substantially beyond the bearing 57 to support a gear 59 nonrotatably secured thereto.

The lower shaft 56 is rotatably supported within the bearings 62 and 63 which are mounted in the front wall 47 and rear wall 48, respectively. The front end of the shaft 56 projects substantially beyond the bearing 62 for support of a gear 64 which is nonrotatably secured to said shaft 56 and drivingly engaged with the gear 59. The rear end of the shaft 56 projects beyond the bearing 63 to support a gear 66 nonrotatably secured thereto, said gear 66 being connected to a conventional drive control mechanism 67 (FIG. 2).

The upper roll 52 (FIG. 3) has three annular and radially projecting knife edges 68, 69 and 70 rigidly secured thereto and concentric therewith. The front and rear knife edges 68 and 70, respectively, are preferably spaced from the center knife edge 69 by 0.328 inch in this embodiment and said knife edges are in touching contact with the outer surface of the lower roll 53.

A felt strip guide 73 (FIG. 5) includes a horizontal plate 74 which is rigidly secured to, and partially between, the front wall 47 and rear wall 48 of the head 46. The plate 74 has an upper surface which is preferably substantially in a horizontal plane tangent to the upper surface of the lower roll 53. The felt strip guide 73 also includes a pair of spaced vertical retainers 76 and 77 which are mounted upon the upper surface of the plate 74 and have slots 78 and 79, respectively, through which the felt strip 42 can readily slide while being held closely adjacent the upper surface of the plate 74. The retainer 77 is preferably almost in the bight between the two rolls 52 and 53.

Lateral guiding (FIG. 5) of the felt strip 42 is provided by a pair of antifriction bearings 81 and 82 which are mounted upon the plate 74 for rotation around parallel vertical axes. The bearings 81 and 82 are positioned so that their peripheries are tangent to a line connecting the front sides of the slots 78 and 79 in the retainers 76 and 77, respectively. The rear edge of the felt strip 42 is engaged by an elongated nylon shoe 83 on the pressure member 84 which extends substantially between the retainers 76 and 77.

The pressure member 84 has a transversely elongated opening 87 extending vertically therethrough. A bolt 88 extends through the opening 87 and is threadedly engaged with the plate 74 in order to minimize vertical movement of the member 84 relative to said plate 74 while permitting relatively free movement of said member 84 around the bolt 88 and lengthwise of the opening 87.

A pair of parallel and horizontal rods 91 and 92 are secured to and extend rearwardly from the pressure member 84 for slidable reception into openings 93 and 94, respectively, in a block 96 which is rigidly secured upon the plate 74 rearwardly of the member 84. Spiral springs 97 and 98 encircle the rods 91 and 92, respectively, and are held under compression so that they continuously urge the shoe 83 of the pressure member 84 against the rearward edge of the felt strip 42.

Figure 6:
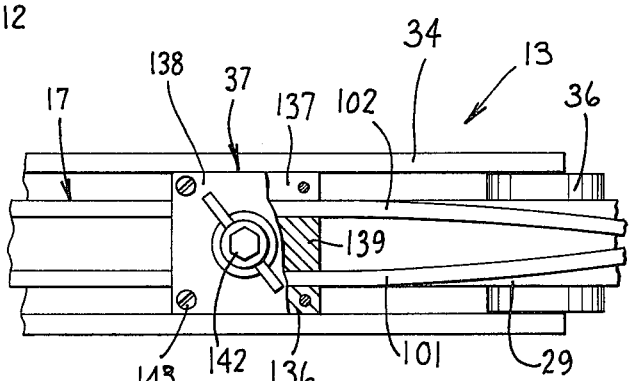
FIG. 6 is an enlarged fragment of FIG. 2 indicated by the line VI—VI in FIG. 1.

In order to assure the provision of accurately dimensioned felt elements 101 and 102 (FIGS. 5 and 6) from the felt strip 42, the initial dimension of the strip 42 is preferably approximately 27/32 of an inch wide. This allows for variations of as much as 1/32 of an inch in the width of the initial strip 42 while still permitting the provision of elements 101 and 102 which are precisely 0.328 inch wide. Thus, the felt strip guide 73 (FIGS. 3 and 5) is arranged so that the knife edges 68, 69 and 70 will always make three, parallel and uniformly spaced cuts in the felt strip 42.

A guide roller 103 (FIGS. 1 and 2) is rotatably mounted upon and between the upper ends of a pair of support arms 106 and 107, which are in turn connected to the rightward end of and extend upwardly from the platform 44. The upper edge of the roller 103 is preferably approximately tangent to a plane defined by the upper surface of the horizontal plate 74. Thus, the felt strip 42 feeds from the roller 103 directly into the felt strip guide 73 on the strip splitter 12.

Figure 5A:
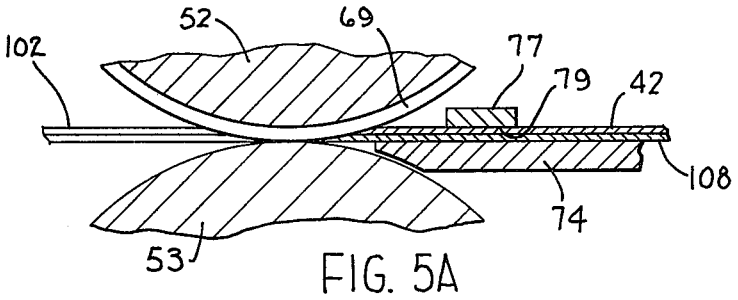
FIG. 5A is an enlarged fragmentary sectional view taken along the line VA—VA in FIG. 5.

The felt strip 42 (FIG. 5A) is coated on its lower side with a pressure sensitive adhesive of a conventional type which is then covered with a thin ribbon 108 of material which covers and protects the adhesive until adhesion of the elements 101 and 102 to the metal band 29 by the strip joiner 13 is desired.

As the felt strip 42 passes between the rolls 52 and 53 (FIG. 5A), it is cut by the knife edges 68, 69 and 70 (FIG. 3) to form the aforesaid felt elements 101 and 102 (FIG. 5) as well as the edge pieces 111 and 112 which are expendable. A container 113 is disposed between the strip splitter 12 and the joiner 13 to receive the edge pieces 111 and 112 as they depart from the rolls 52 and 53. The elements 101 and 102 are loosely fed from said rolls 52 and 53 (FIG. 1) upwardly over a guiding and stripping device 114 which is mounted upon the rightward end of the strip joiner 13.

The guiding and stripping device 114 is comprised of an elongated articulated arm 116 which preferably extends upwardly and rightly somewhat above the cutting head 46 of the strip splitter 12. The lower end of the arm 116 is mounted upon the rightward end of the platform 34. An upper roller 117 is supported at the upper end of the arm 116 for rotation around a horizontal axis. A lower roller 118 is mounted upon the arm 116 between the upper and lower ends thereof for rotation about a horizontal axis parallel with the axis of the roller 117.

The felt elements 101 and 102, along with the portions of the ribbon 108 secured thereto, are fed upwardly over the roller 117. However, when the elements 101 and 102 reach the roller 118, the felt portions and ribbon portions are stripped from each other by passing on opposite sides of the roller 118. The ribbon portions 119 extend downwardly between a pair of rolls 122 and 123 which are substantially tangent and, therefore, tightly grip the ribbon portions 119 therebetween. The rolls 122 and 123 are rotatably supported upon a bracket 124 mounted upon an upright 126 which is supported upon the floor 19. The rolls are interconnected by gears 127 which are in turn driven by the drive and control mechanism 67. The rolls 122 and 123 are rotated so that the ribbon portions 119 are moved downwardly into the container 113.

While the rolls 52 and 53 are driven by the drive and control mechanism 67, it is advantageous to make such driving intermittent upon demand. Accordingly, a switch 128, which controls the driving of the gear 66 (FIG. 4) is mounted upon the top wall 49 of the cutting head 46. The switch 128 is normally open and is closed by operation of a lever 129 which is pivotally mounted between its ends by the pivot member 132 mounted upon said top wall 49 adjacent the leftward edge thereof. As shown in FIG. 1, the lever 129 extends downwardly and, as shown in FIG. 2, has a broad lower end 133 which is engageable by the felt elements 101 and 102 as the portions thereof between the head 46 and the roller 117 are raised above a predetermined height. The raising of the lever 129, hence actuation of the switch 128, causes the rolls 52 and 53 to be rotated for a predeterminable length of time whereby to replenish the amount of the felt elements 101 and 102 available to the joiner 13.

As the felt elements 101 and 102 (FIG. 2) depart the roller 118, they are fed downwardly and leftwardly into the strip guide 37 on top of the metal strip 29 (FIG. 6) where they are attached by the adhesive thereon to the metal strip 29 adjacent the opposite lengthwise edges thereof.

The strip guide 37 is preferably made from a self-lubricating material, such as nylon, and is comprised of a pair of parallel edge blocks 136 and 137 which are rigidly secured to the upper surface of the platform 34 and spaced from each other approximately the same distance as the width of the metal strip 29 which is guided therebetween. The strip guide 37 also includes an upper plate 138 which is secured to and upon the blocks 136 and 137. The top plate 138 has a downwardly extending projection 139 which is parallel with and spaced from the blocks 136 and 137, such spacing being approximately 0.328 inch so that the elements 101 and 102 will slide smoothly between the adjacent sides of the blocks 136 and 137 and the projection 139 on the plate 138. The thicknesses of the projection 139 and the blocks 136 and 137 are selected so that the felt elements 101 and 102 will be pressed against the upper surface of the metal strip 29, thereby causing the adhesive material on the lower surface of said elements to adhere to the strip 29. A manually operable bolt 142 extends through the upper plate 138 and engages the platform 34 for adjusting the pressure of the upper plate 138 against the felt strips 101 and 102. However, the plate 138, as well as the blocks 136 and 137, are held in position by the corner screws 143 which extend through the blocks 136 and 137, and are threadedly received into appropriate openings in the platform 34.

A pair of upper and lower driven rolls 145 and 146 are rotatably supported upon the leftward end of the platform 34 for rotation around parallel horizontal axes extending transversely of the said platform 34. The workpiece 17, which comprises the metal band 29 with the felt elements 101 and 102 adhered thereto, is gripped between the rolls 145 and 146 as said workpiece moves away from the strip guide 37. As shown in FIG. 2, the rolls 145 and 146 are connected to the drive and control mechanism 67 for effecting rotation thereof whereby the strips, hence the workpiece 17, are pulled through the strip guide 37.

Figure 9:
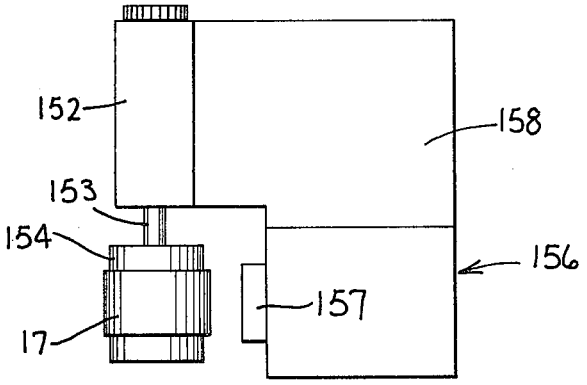
FIG. 9 is an enlarged fragment of FIG. 2 as viewed from the line IX—IX in FIG. 1.

The workpiece 17 (FIG. 1) is discharged from the rollers 145 and 146 so that it drapes downwardly into a container 150 which is disposed adjacent to and below the inspection unit 14. Said inspection unit 14 (FIG. 1) is comprised of an upright post 151 upon the top of which is mounted a drive unit 152 (FIG. 9) having a shaft 153 extending horizontally frontwardly therefrom for rotation thereby. A pulley 154 is mounted to and rotatable with the shaft 153, and the drive unit 152 is connected to and driven by the drive and control mechanism 67.

The workpiece 17 is fed upwardly on the left side of the pulley 154, over the top and then downwardly from the right side of said pulley back into the container 150. As the workpiece 17 makes its trip up to and then down from the pulley 154, it can be visually inspected for imperfections which, for example, may have been in the original strip material.

Alternatively, the inspection unit may be equipped with an electronically operated scanning device 156 of a substantially conventional type having optics 157 directed toward a reach of the workpiece 17 going upwardly toward or downwardly from the pulley 154. The scanning device 156 may be mounted upon a support 158 which is rigidly secured to the post 151 near its upper end. The scanning device 156 would be electrically connected to the drive and control mechanism 67 in order to interrupt the operation of the drive unit 152, and produce a light or sound signal indicating that an imperfection has been detected in the workpiece.

The workpiece 17 moves upwardly from the container 150 (or downwardly from the pulley 154) into and through the punch feed 161 which is located at the input or rightward end of the punch press 16. The workpiece 17 is then advanced by said punch feed 161 through and between the upper and lower platens 159 and 160, respectively, of the punch press 16 whereby the desired notching and distorting or bending operations are performed on the workpiece. Because of the criticality of this operation, a manually operable switch 165 is provided in close association with the punch feed 161 and connected to the drive control mechanism 67 for de-energizing same in the event of a malfunction, jamming or other improper performance of the punch press 16.

The tools and dies in the punch press 16 may be fabricated by conventional procedures from well established materials to operate in a conventional manner. That is, the upper platen 159 is vertically reciprocable and has punches and dies mounted thereon, whereas the lower platen 160 has dies.

Figure 7:
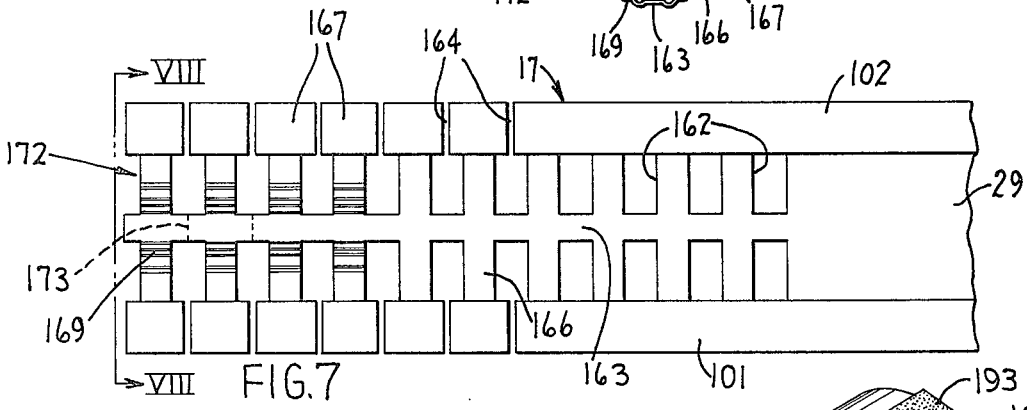
FIG. 7 is an enlarged fragment of a workpiece as viewed from the line VII—VII in FIG. 1.

As the workpiece 17 (FIG. 7) moves from right to left (as appearing in FIG. 1) through the punch press 16, the first operation performed thereon is the punching of the rectangular openings or notches 162 through the metal band 29 between the felt elements 101 and 102. The openings 162 are arranged in two rows running lengthwise of the workpiece 17 adjacent, respectively, to the felt elements 101 and 102, and they are disposed in transversely spaced and aligned pairs whereby to provide a connecting strip or central portion 163 down the lengthwise mid-section of the band 29, hence of the workpiece 17.

In a second operation, the felt elements 101 and 102, as well as the portions of the strip 29 adhered thereto, are cut by a punching operation so that a plurality of uniformly spaced separations 164 are provided along the elements 101 and 102 and the adjoining portions of said band 29. The separations 164 are arranged so that they communicate with the notches 162 midway between those edges thereof extending transversely of the band 29. Accordingly, the notches 162 and separations 164 define a plurality of spring fingers 166 which extend from opposite sides of the central portion 163 and are arranged in transversely aligned pairs along the workpiece 17. It will be recognized that, under some circumstances, it may be desirable to produce the notches 162 and separations 164 in a single punching operation.

Figure 8:
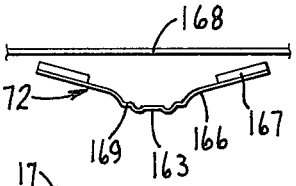
FIG. 8 is an end view of the workpiece as appearing from the line VIII—VIII in FIG. 7 with a piece of tape.

The separations 164 convert the elongated felt elements 101 and 102 into small felt pads 167 which, as shown in FIG. 8, are capable of engaging a magnetic tape 168, such as those found in a conventional tape cartridge used to record and reproduce sound.

Following the punching operations, each transverse pair of fingers 166 is struck and distorted with bending dies which result in distortions thereof, as appearing in FIG. 8, whereby said fingers are deflected upwardly from the plane of the central portion 163. The distortions or bends 169 in each of the fingers 166 are arranged to permit substantial deflections of the fingers 166 in a direction perpendicular to the plane of the central portion 163 repeatedly over long periods of time without fatigue.

The distortions 169 can be produced on each finger 166 in a series of bending or deforming steps and such has been found advantageous because of the inherent characteristics of the metal band 29. That is, the grain in the metal band 29 tends to run lengthwise thereof so that resiliency, as opposed to fatigue, is better in a deflection around an axis transverse of the band 29. However, by sequencing the bending operations performed on the fingers 166 to produce the distortions 169, the flexibility of the fingers and their resilience is enhanced. In one test, a finger 166 was deflected relative to and in a direction perpendicular to the central portion 163 several times without any detachable fatigue in the finger.

Ultimately, when an aligned pair of fingers is to be used as a spring unit 172 the central portion 163 is severed between it and the adjacent spring unit along the broken line 173.

A tube 174 is connected to the lower platen 160 for collecting and discharging slugs punched out of the workpiece 17 and depositing them in a container 176 below the punch press 16.

After the notching, cutting and bending operations have been performed on the workpiece 17 by the punch press 16, the workpiece moves leftwardly from the punch press along a guide 177 to the workpiece receiving unit 18 (FIGS. 1 and 2). Specifically, the workpiece receiving unit 18 is comprised of an upright frame 180 having a bearing 181 mounted upon the upper end thereof for rotatably supporting a horizontal shaft 182 which extends frontwardly from said bearing 181. The shaft 182 is connected to and driven by the drive and control mechanism 67.

Figure 11:
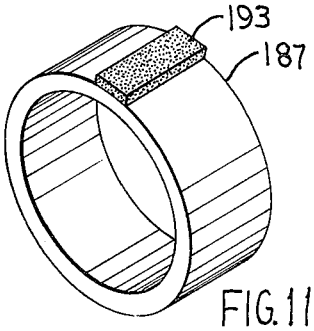
FIG. 11 is a perspective view of an annular core upon which the finished workpiece is wound.

A spool 183 having a removable front side plate 184, is mounted upon the shaft 182 for rotation therewith. The spool has a spindle 186 around which an annular core 187 is sleeved for rotation with said spindle. The side plate 184 has a hub 188 whereby the side plate can be locked, as with a set screw 189, upon the shaft 182. The core 187 is gripped between the front side plate 184 and a rear side plate 192. A resiliently flexible cushion 193 (FIG. 11) is fastened to the periphery of the core 187, and the free end of the string of spring units 172 (that is, the workpiece 17) is threaded between the side plates 184 and 192 and wrapped around a portion of the core 187 including the cushion 193. The spacing between the side plates 184 and 192 is such that the spring fingers 166 are deflected a small amount, upwardly as appearing in FIG. 8, thereby removably and releasably holding the string or workpiece 17 on the spool 183. However, the cushion 193 prevents relative rotation between the coiled workpiece 17 and the spool 183.

An arm 194 is pivotally mounted at its leftward end by a yoke 196 upon a bracket 197 secured to the frame 180. The arm 194 extends rightwardly from the yoke 196 for engagement by the urging of gravity with the upper surface of the workpiece 17 as it is being wound upon the spool 183. Thus, the arm 194 tends to provide a relatively tight roll 198 of the workpiece.

After a roll 198 of the workpiece 17 has been formed to the desired diameter, the front side plate 184 is removed so that the roll 198 (FIG. 12) along with its supporting core 187 can be removed from the workpiece receiving unit 18.

Figure 12:
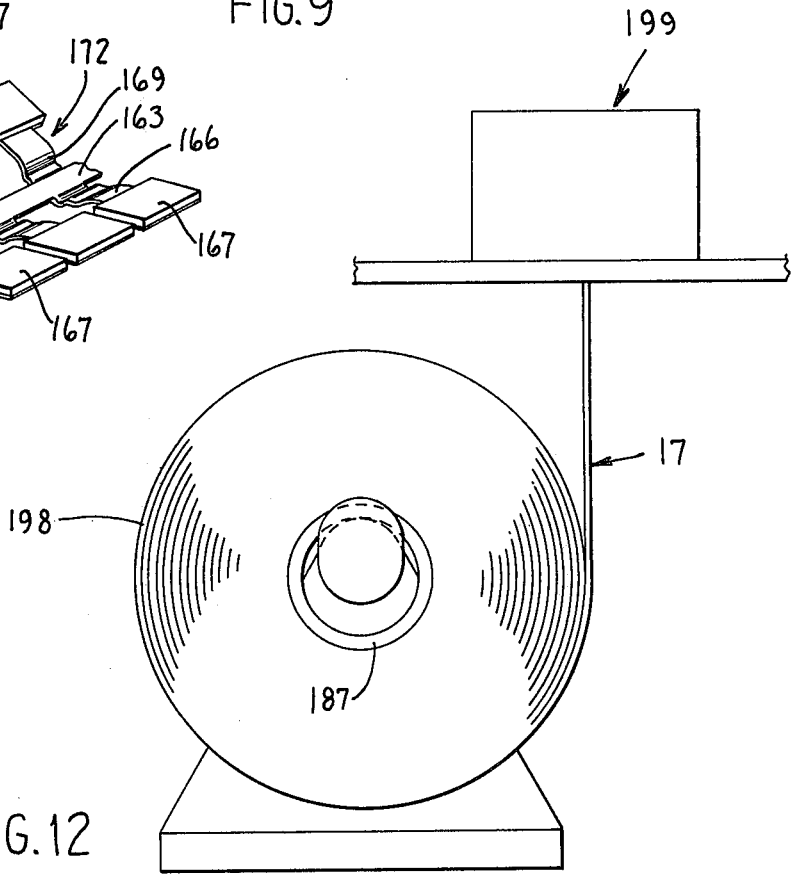
FIG. 12 is a side elevational view of a roll of the wound workpiece with the free end thereof being fed into a spring installing mechanism.

As shown in FIG. 12, the roll 198 can then be transferred to a separate apparatus for feeding the workpiece 17 into a mechanism 199 for severing the central portion 163 (FIG. 7) between each pair of spring units 172 and automatically installing such spring units into the casings for tape cartridges. Alternatively, the workpiece 17 can be fed directly from the punch press 16 into a mechanism 199 for installing said spring units 172.

OPERATION

While the operation of the apparatus disclosed above will be apparent to skilled persons upon reading the foregoing description, a brief summary of such operation will follow.

As shown in FIGS. 1 and 2, the flow of material and the sequence of operations occurs from right to left. The felt strip 42 on the spool 40 is moved through the splitter 12 which produces the elongated felt elements 101 and 102 which, enroute to the joiner 13, are stripped of ribbons that protect an adhesive on the lower sides of said elements. The metal band 29 is fed from the spool 27 and joins the felt elements 101 and 102 at the joiner 13. Specifically, the metal band 29 and elements 101 and 102 are fed through the guide 37 whereby the elements are attached by said adhesive to the upper surface of the band 29 adjacent the opposite lengthwise edges thereof to form the workpiece 17.

Figure 10:
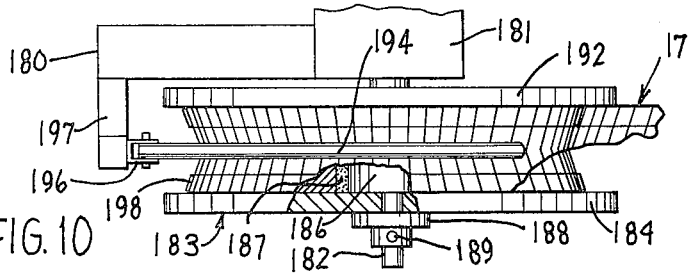
FIG. 10 is an enlarged fragment of FIG. 2 as viewed from the line X—X in FIG. 1.
Figure 13:
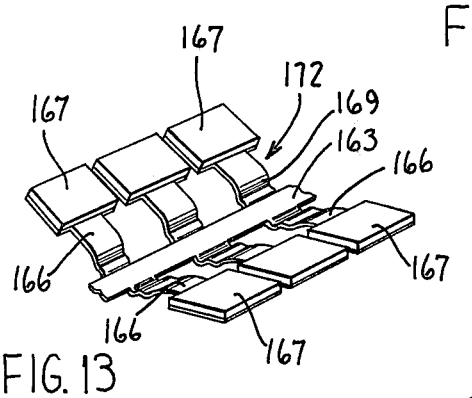
FIG. 13 is a fragmentary perspective view of the workpiece.

The workpiece 17 is drawn through the guide 37 by the power driven rolls 145 and 146, after which it is then looped over the power driven pulley 154 so that said workpiece can be inspected or scanned either visually or by optical equipment for imperfections. The workpiece is then moved through the punch press 16 where notching, cutting and bending operations are performed upon the workpiece whereby to produce a plurality of interconnectioned spring units 172, as appearing in FIGS. 7, 8 and 13. The finished workpiece is then rolled upon a spool 183 (FIG. 10) for transport to a location where the spring units 172 can be fed to a mechanism 199 (FIG. 12) by which said units are separated from the workpiece and installed in tape cartridges, such as those commonly known as eight-track cartridges.

Alternatively, however, the mechanism 199 can be installed at the left end of the apparatus 10 in place of the workpiece receiving unit 18, whereby the installation of the spring units 172 can be performed as a step in the method of producing the spring unit.

Although a particular preferred embodiment of the invention has been disclosed in detail for illustrative purposes, it will be recognized that variations or modifications of the disclosed method and apparatus, including the rearrangement of parts, lie within the scope of the present invention.

The embodiments of the invention in which an exclusive property or privilege is claimed are defined as follows:

1. In a process for fabricating spring means for positioning within a cartridge having a tape capable of recording electromagnetic impulses, the steps comprising:

applying a pair of elongated flexible elements to one side of an elongated, relatively thin band of resiliently flexible material, said elements being parallel, substantially spaced from each other and located adjacent the lengthwise edges of said band;

providing said band with a plurality of uniformly spaced notches in both edges thereof and severing said elements adjacent said notches, said notches extending inwardly to a lengthwise central portion of said band to define a plurality of parallel and spaced, spring fingers arranged in transversely aligned pairs extending in opposite directions from said central portion of said band;

sequentially applying first distortions to said spring fingers; and sequentially applying second distortions to said spring fingers whereby the free ends of said fingers are offset relative to said central portion of said band in the direction of said elements.

2. The method of claim 1, wherein said notches have enlarged portions disposed in two parallel rows between said elements and on opposite sides of said central portion of said band, and narrow portions extending between said enlarged portions and the adjacent edges of said band, said enlarged portions being punched before said narrow portions.

3. The method of claim 1, wherein said elongated flexible elements are cut from a single elongated strip of flexible material having a pressure sensitive adhesive on one side thereof.

4. A method of fabricating a resiliently flexible spring for engaging a tape, the steps comprising:

applying a pair of elongated, flexible and compressible elements to the same side of an elongated, relatively thin band of resiliently flexible material, said elements being spaced from each other and located adjacent the lengthwise edges of said band;

notching both edges of said band and severing said elements adjacent said notches, said notches extending inwardly to a lengthwise central portion of said band, said notches defining a plurality of parallel and spaced spring fingers arranged in transversely aligned pairs extending in the opposite directions from said central portion of said band, all but two of said aligned pairs being disposed between, and connected by said central portion to, other aligned pairs of spring fingers whereby to form a string of interconnected spring fingers;

sequentially applying distortions to said spring fingers whereby the free ends of said fingers are offset relative to said central portion of said band in the direction of said elements; and forming said string into a roll in which said spring fingers extend axially of the roll.

5. The method of claim 4, wherein said distortions are directed transversely of the plane defined by said central portion; and wherein said compressible elements are cut from a single strip of compressible material having a pressure sensitive adhesive on one side thereof.

6. The method of claim 4, wherein said band of resiliently flexible material and said compressible elements are automatically advanced by power driven means from sources thereof, both individually and collectively, to the means forming a roll thereof.

* * * * *